US007992984B2

(12) United States Patent
Toba et al.

(10) Patent No.: US 7,992,984 B2
(45) Date of Patent: Aug. 9, 2011

(54) LIQUID CONTAINER

(75) Inventors: Koichi Toba, Shiojiri (JP); Shuichi Koganehira, Matsumoto (JP); Shohei Shiono, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 444 days.

(21) Appl. No.: 12/182,907

(22) Filed: Jul. 30, 2008

(65) Prior Publication Data

US 2009/0033725 A1 Feb. 5, 2009

(30) Foreign Application Priority Data

Aug. 1, 2007 (JP) ..... 2007-200709

(51) Int. Cl.
*B41J 2/175* (2006.01)
*B41J 2/195* (2006.01)

(52) U.S. Cl. ..... 347/86; 347/7

(58) Field of Classification Search ..... 347/84–87, 347/7

See application file for complete search history.

(56) References Cited

U.S. PATENT DOCUMENTS 5,988,782 A * 11/1999 Miura et al. ..... 347/6

FOREIGN PATENT DOCUMENTS

| | | |
|---|---|---|
| JP | 2003-266730 | 9/2003 |
| JP | 2006-001082 | 1/2006 |
| JP | 2006-001175 | 1/2006 |
| JP | 2006-001240 | 1/2006 |
| WO | 2006/104266 A1 | 10/2006 |

* cited by examiner

*Primary Examiner* — An H Do

(57) ABSTRACT

A liquid container for supplying a liquid to a liquid consuming apparatus includes: a liquid containing section that contains the liquid; a liquid supply section that supplies the liquid to the liquid consuming apparatus; a liquid flow section that connects from the liquid containing section to the liquid supply section; a sensor that is provided in the liquid flow section and used for detecting presence or absence of the liquid at a corresponding position thereof; and a stirring member that stirs the liquid, the stirring member is provided at a position between the sensor and the liquid supply section in the liquid flow section.

19 Claims, 13 Drawing Sheets

LIQUID CONTAINER

BACKGROUND

1. Technical Field

The present invention relates to a liquid container for supplying a liquid to a liquid consuming apparatus.

2. Related Art

There is known an ink jet printer that has mounted therein an ink cartridge containing ink and performs printing on a printing medium with ink supplied from the ink cartridge. As for ink contained in such an ink cartridge, for example, pigment ink in which a plurality of components having different specific gravities are mixed is used. A component having high specific gravity in the pigment ink may be settled as time elapses, and thus ink uniformity may be deteriorated.

Accordingly, there is suggested a technology that improves ink uniformity by disposing a stirring member in an ink containing chamber of the ink cartridge (for example, see JP-A-2006-1240).

JP-A-2006-1082, JP-A-2006-1175, and JP-A-2003-266730 are examples of the related art.

However, the stirring member is located apart from an ink supply port of the ink cartridge, and after passing a position at which the stirring member is disposed, ink is likely to be settled, and thus further improvement of ink uniformity is increasingly demanded. This problem may occur in a liquid container for supplying a liquid to a liquid consuming apparatus, for example, a liquid container for supplying a liquid material to an ejecting apparatus, which ejects a liquid material including a metal on a semiconductor to form an electrode layer, as well as an ink cartridge for an ink jet printer.

SUMMARY

An advantage of some aspects of the invention is that it is possible to improve uniformity of a liquid contained in a liquid container.

The advantage can be attained by at least one of the following aspects.

According to an aspect of the invention, there is provided a liquid container for supply a liquid to a liquid consuming apparatus. The liquid container includes: a liquid containing section that contains the liquid; a liquid supply section that supplies the liquid to the liquid consuming apparatus; a liquid flow section that connects from the liquid containing section to the liquid supply section; a sensor that is provided in the liquid flow section and used for detecting presence or absence of the liquid at a corresponding position thereof; and a stirring member that stirs the liquid, the stirring member is provided at a position between the sensor and the liquid supply section in the liquid flow section.

With this liquid container, the stirring member is provided at the position between the sensor and the liquid supply section in the liquid flow section. Therefore, even after out-of-ink is detected using the sensor, a liquid remaining in the liquid container can be improved in uniformity. As a result, the liquid can be maintained in uniformity until the liquid container runs out of ink.

The liquid container according to the aspect of the invention may further comprises a buffer chamber that is provided at a position between the sensor and the liquid supply section in the liquid flow section. The stirring member may be disposed in the buffer chamber to stir the liquid in the buffer chamber.

In the liquid container according to the aspect of the invention, the stirring member may have identical specific gravity to or higher specific gravity than a specific gravity that the liquid has. With this configuration, it is possible to efficiently stir the liquid by using the entire stirring member.

The liquid container according to the aspect of the invention, may further comprises a valve accommodating chamber in which a differential pressure regulating valve of the liquid is accommodated. The valve accommodating chamber may be provided at a position between the buffer chamber and the liquid supply section in the liquid flow section and directly communicates with the buffer chamber. With this configuration, a space from the buffer chamber to the liquid supply section can be made small, and a possibility that ink remains and is settled after being stirred can be reduced.

The liquid container according to the aspect of the invention may be mounted in use on a mounting portion which is provided in the liquid consuming apparatus to reciprocate in a predetermined movement direction. The buffer chamber may include a movement direction flow section in which the liquid flows along the movement direction, and the stirring member may be disposed in the movement direction flow section of the buffer chamber. With this configuration, the stirring member can be moved by the reciprocation of the mounting portion, thereby stirring the liquid. In addition, even when the mounting portion is not in reciprocation, the stirring member can be moved by the flow of the liquid, thereby stirring the liquid.

In the liquid container according to the aspect of the invention, a ratio of a projected area of the stirring member on a plane perpendicular to the movement direction to a projected area of the movement direction flow section on the plane may be 15% or more. With this configuration, the liquid can be sufficiently stirred only with the movement of the stirring member in the movement direction.

In the liquid container according to the aspect of the invention, a ratio of a projected area of the stirring member on a plane perpendicular to the movement direction to a projected area of the movement direction flow section on the plane may be 30% or less. With this configuration, it is possible to prevent the stirring member from interfering with the flow of the liquid.

In the liquid container according to the aspect of the invention, the movement direction flow section may include an inflow port through which the liquid flows into the movement direction flow section, the inflow port may have a diameter smaller than a diameter of the stirring member and being provided at an inner wall perpendicular to the movement direction. With this configuration, when a mobile member moves so as to be opposed to an inflow direction of the liquid, the liquid can be effectively stirred.

In the liquid container according to the aspect of the invention, a width of the stirring member in a gravity direction may be approximately half or more of a width of the movement direction flow section in the gravity direction. Furthermore, a width of the movement direction flow section in the movement direction may be larger than a width of the movement direction flow section in a direction perpendicular to the movement direction and the gravity direction. With this configuration, the liquid can be sufficiently stirred only with the movement of the stirring member in the movement direction.

In the liquid container according to the aspect of the invention, a ratio of a volume of the stirring member to a volume of the movement direction flow section may be 5% or more. With this configuration, the entire ink in the movement direction flow section can be sufficiently by means of the stirring member.

In the liquid container according to the aspect of the invention, a ratio of a volume of the stirring member to a volume of the movement direction flow section may be 15% or less. With this configuration, it is possible to prevent the stirring member from interfering with the flow of the liquid in the movement direction flow section.

BRIEF DESCRIPTION OF THE DRAWINGS

The invention will be described with reference to the accompanying drawings, wherein like members reference like elements.

DESCRIPTION OF EXEMPLARY EMBODIMENTS

An exemplary embodiment of the invention will now be described with reference to the drawings.

Embodiment

Figure 1:
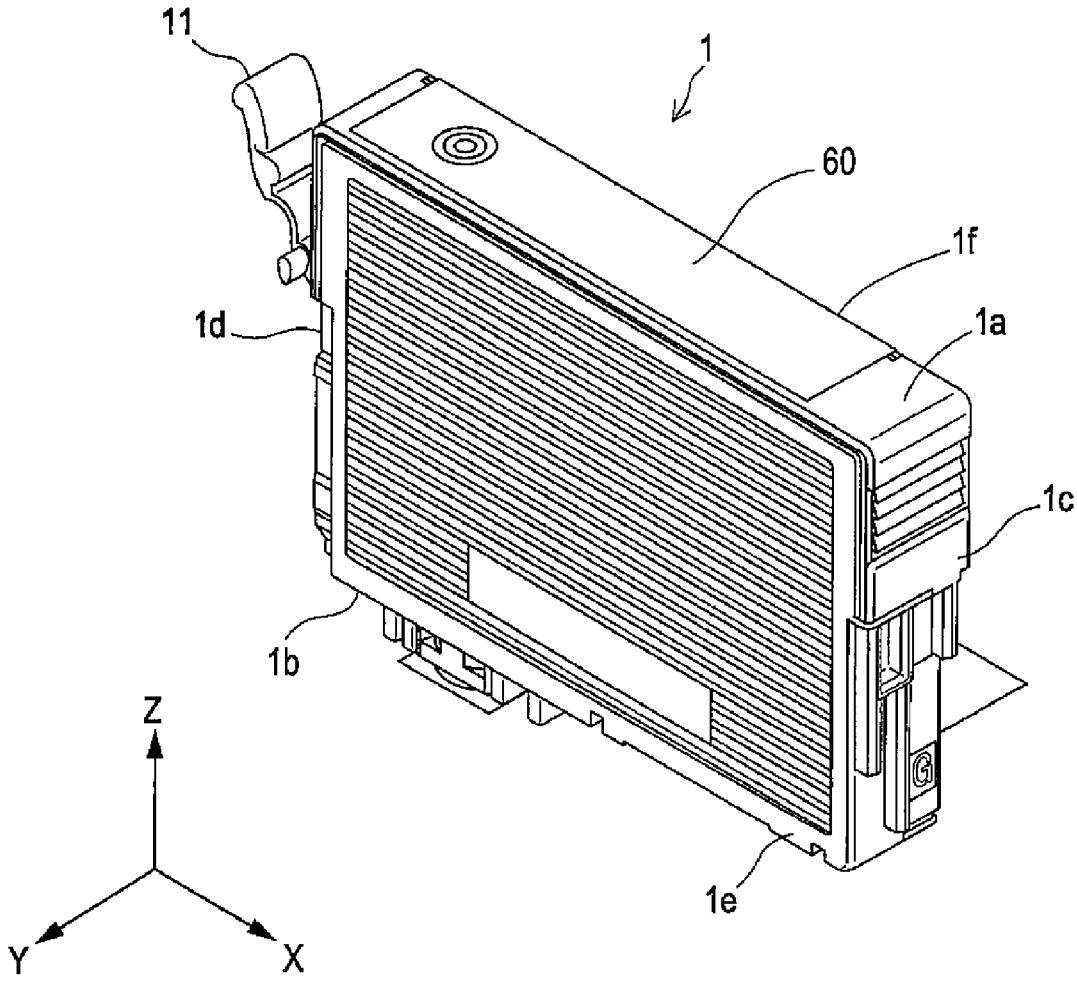
FIG. 1 is a first exterior perspective view of an ink cartridge according to an embodiment of the invention.
Figure 2:
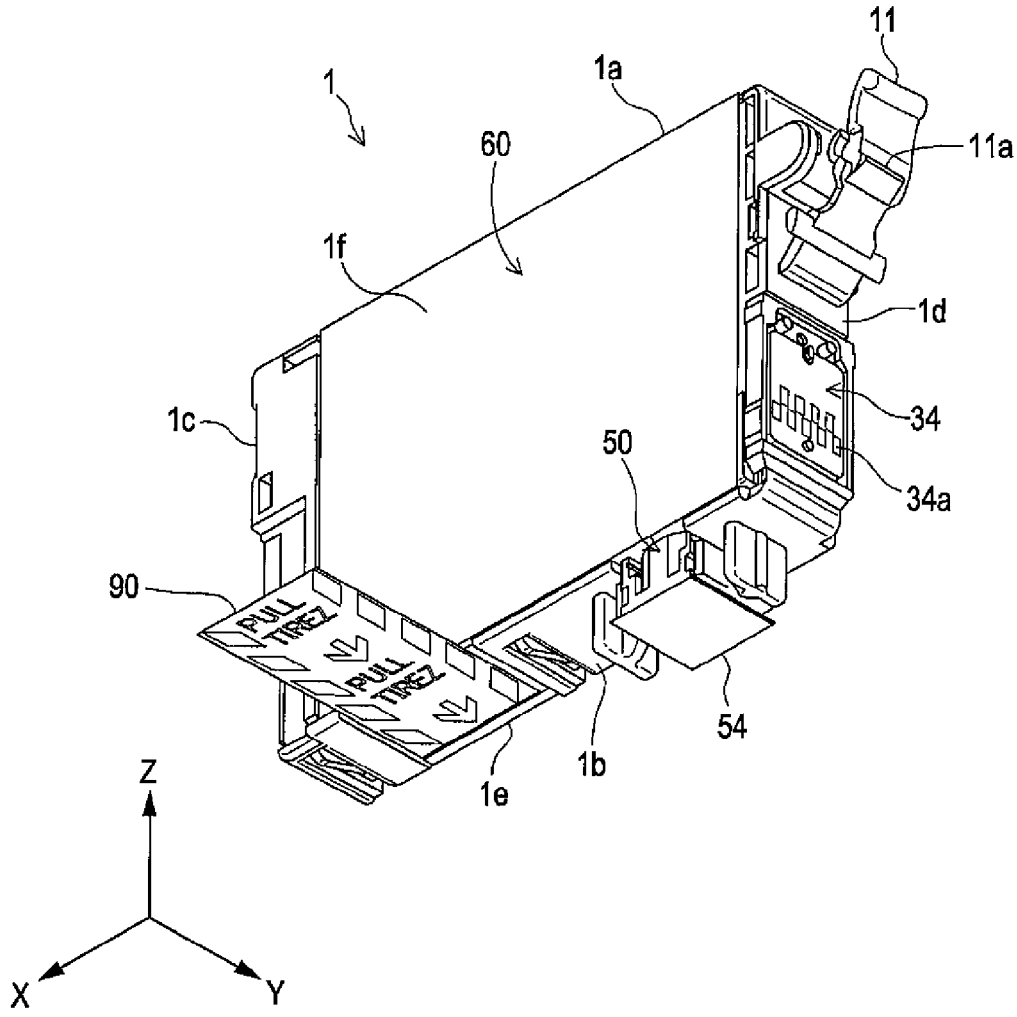
FIG. 2 is a second exterior perspective view of an ink cartridge according to an embodiment of the invention.
Figure 3:
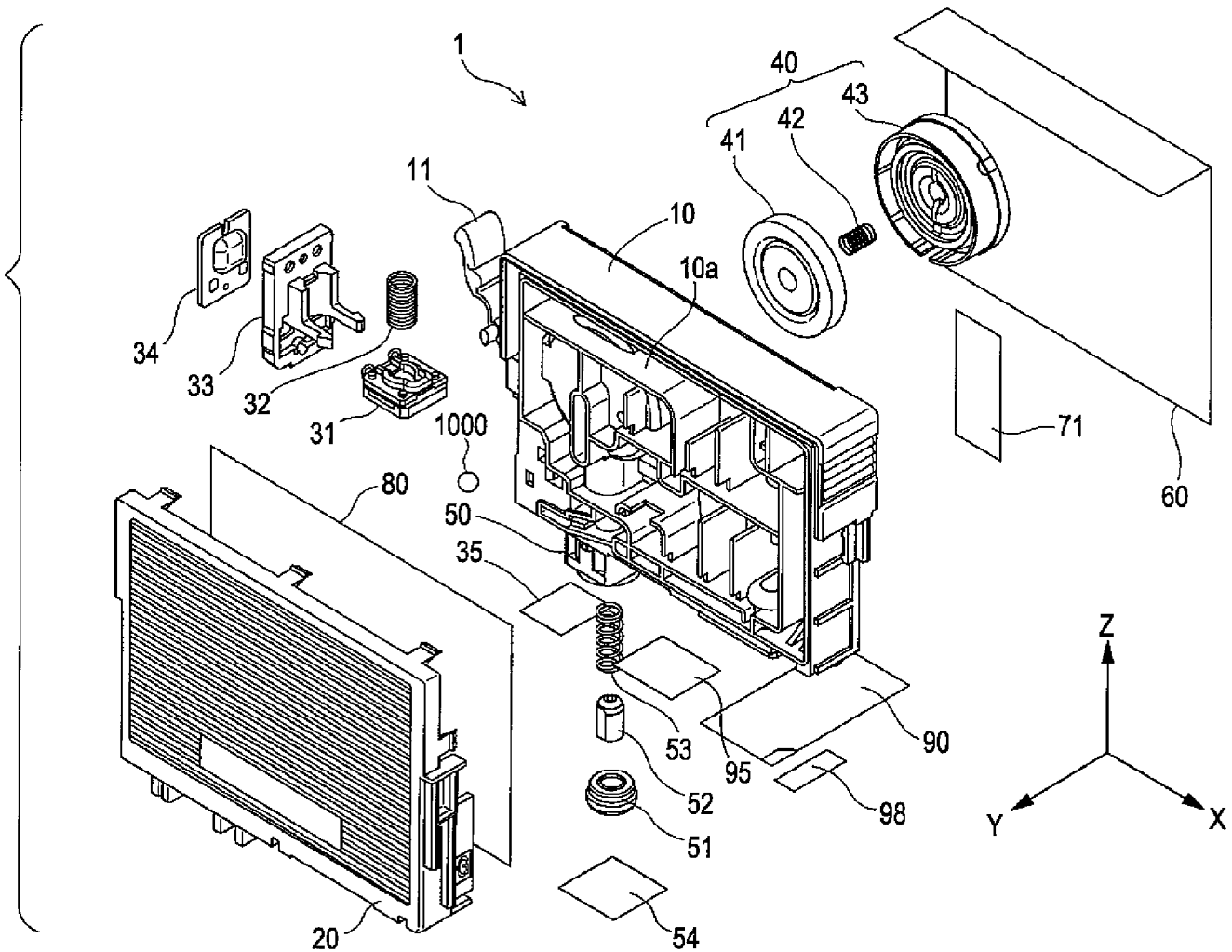
FIG. 3 is a first exploded perspective view of an ink cartridge according to an embodiment of the invention.
Figure 4:
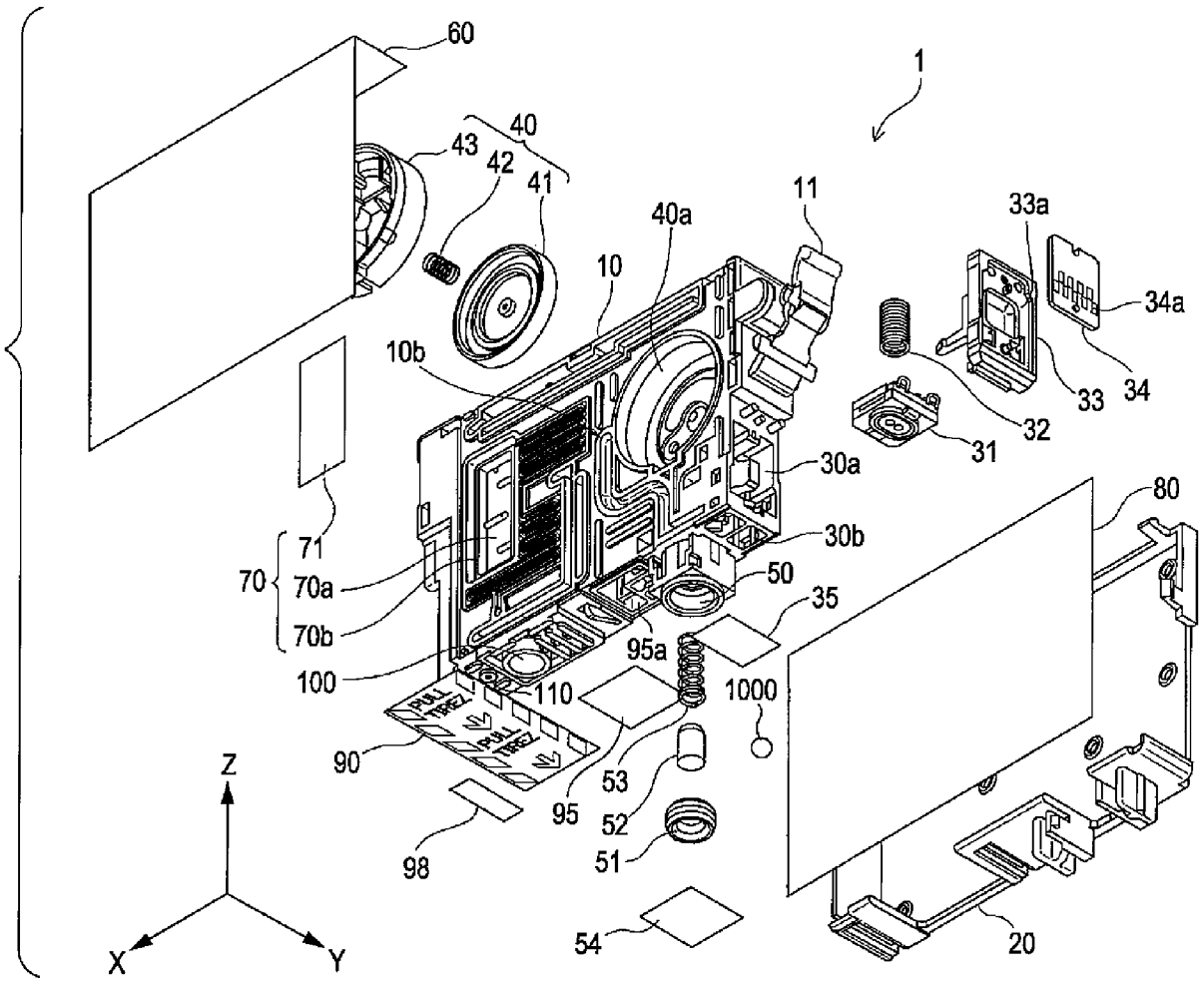
FIG. 4 is a second exploded perspective view of an ink cartridge according to an embodiment of the invention.
Figure 5:
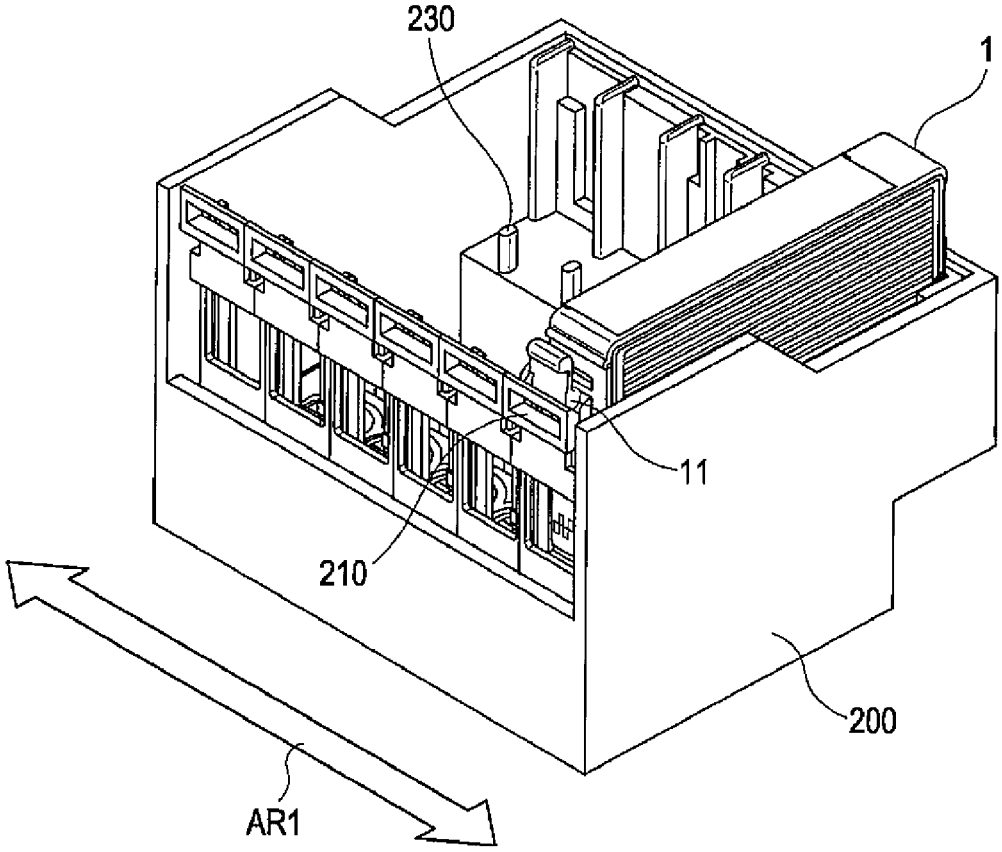
FIG. 5 is a diagram showing a state in which an ink cartridge is attached to a carriage.

FIG. 1 is a first exterior perspective view of an ink cartridge as a liquid container according to an embodiment of the invention. FIG. 2 is a second exterior perspective view of an ink cartridge according to the embodiment of the invention. FIG. 2 is a diagram when viewed from the opposite direction to that of FIG. 1. FIG. 3 is a first exploded perspective view of an ink cartridge according to the embodiment of the invention. FIG. 4 is a second exploded perspective view of an ink cartridge according to the embodiment of the invention. FIG. 4 is a diagram when viewed from the opposite direction to that of FIG. 3. FIG. 5 is a diagram showing a state in which an ink cartridge is attached to a carriage. In FIGS. 1 to 5, the XYZ axes are shown in order to specify the directions.

An ink cartridge 1 contains ink as a liquid therein. As shown in FIG. 5, the ink cartridge 1 is mounted on a carriage 200 of an ink jet printer, and supplies ink to the ink jet printer.

As shown in FIGS. 1 and 2, the ink cartridge 1 has a substantially rectangular parallelepiped shape. The ink cartridge 1 has a surface 1*a* on the positive Z-axis side, a surface 1*b* on the negative Z-axis side, a surface 1*c* on the positive X-axis side, a surface 1*d* on the negative X-axis side, a surface 1*e* on the positive Y-axis side, and a surface 1*f* on the negative Y-axis side. Hereinafter, for convenience of explanation, the surface 1*a* is referred to as the top surface, the surface 1*b* is the bottom surface, the surface 1*c* is the right surface, the surface 1*d* is the left surface, the surface 1*e* is the front surface, and the surface 1*f* is the back surface. In addition, the sides on which the surfaces 1*a* to 1*f* are disposed are referred to as the top surface side, the bottom surface side, the right surface side, the left surface side, the front surface side, and the back surface side, respectively.

At the bottom surface 1*b* is a liquid supply section 50 which has a supply port for supplying ink to the ink jet printer. An air releasing port 100 for introducing air inside of the ink cartridge 1 is formed at the bottom surface 1*b* (FIG. 4).

The air releasing port 100 has such depth and diameter that a protrusion 230 (FIG. 5) formed in the carriage 200 of the ink jet printer is fitted thereinto while leaving a margin at a predetermined gap. A user removes a sealing film 90 for sealing the air releasing port 100 airtight, and then mounts the ink cartridge 1 on the carriage 200. The protrusion 230 is provided to prevent the user from missing the removal of the sealing film 90.

As shown in FIGS. 1 and 2, at the left surface 1*d*, an engagement lever 11 is provided. A protrusion 11*a* is formed in the engagement lever 11. When the ink cartridge 1 is mounted on the carriage 200, the protrusion 11*a* is engaged with a convex portion 210 formed in the carriage 200, such that the ink cartridge 1 is fixed to the carriage 200 (FIG. 5). As understood from the above description, the carriage 200 serves as a mounting portion on which the ink cartridge 1 is mounted. When the ink jet printer performs printing, the carriage 200 reciprocates in a width direction of a printing medium (main scanning direction) together with a printing head (not shown) as a single body. The main scanning direction is represented by an arrow AR1 in FIG. 5. That is, when the ink jet printer performs printing, the ink cartridge 1 reciprocates along the Y-axis direction in the drawings.

Below the engagement lever 11 at the left surface 1*d*, a circuit board 34 is provided (FIG. 2). A plurality of electrode terminals 34*a* are formed on the circuit board 34. The electrode terminals 34*a* are electrically connected to the ink jet printer through electrode terminals (not shown) provided in the carriage 200.

An outer surface film 60 is adhered to the top surface 1*a* and the back surface 1*f* of the ink cartridge 1.

The internal configuration and parts of the ink cartridge 1 will be described with reference to FIGS. 3 and 4. The ink cartridge 1 has a cartridge main body 10, and a cover member 20 that covers the front surface of the cartridge main body 10.

On the front surface of the cartridge main body 10, ribs 10*a* having various shapes are formed (FIG. 3). A film 80 is disposed between the cartridge main body 10 and the cover member 20. The film 80 covers the front surface of the cartridge main body 10. The film 80 is adhered tight to the front end surfaces of the ribs 10*a* of the cartridge main body 10 such that no clearance is generated. The ribs 10*a* and the film 80 defines a plurality of small chambers, for example, an ink containing chamber and a buffer chamber (described below), in the ink cartridge 1. A stirring ball 1000 is disposed in the buffer chamber to stir ink in the buffer chamber. These chambers and the stirring ball 1000 will be described below.

At the back surface of the cartridge main body 10, a valve accommodating chamber 40*a* and an air-liquid separating chamber 70*a* are formed (FIG. 4). The valve accommodating chamber 40*a* accommodates a differential pressure regulating valve 40 that has a valve member 41, a spring 42, and a spring retainer 43. A bank 70*b* is formed at an inner wall surrounding the bottom surface of the air-liquid separating chamber 70*a*, and an air-liquid separating film 71 is adhered to the bank 70*b*. The bank 70*b* and the air-liquid separating film 71 form an air-liquid separating filter 70.

At the back surface of the cartridge main body 10, a plurality of grooves 10*b* are further formed (FIG. 4). These grooves 10*b* form various flow channels (described below), for example, flow channels, through which ink or air flows, between the cartridge main body 10 and the outer surface film 60 when the outer surface film 60 is adhered to cover the substantially entire back surface of the cartridge main body 10.

Next, the structure around the circuit board 34 will be described. On the lower side of the right surface of the cartridge main body 10, a sensor accommodating chamber 30*a* is formed (FIG. 4). The sensor accommodating chamber 30*a* accommodates a sensor 31 and a fixed spring 32. The fixed spring 32 presses the sensor 31 against the inner wall of the bottom surface of the sensor accommodating chamber 30*a* Then, the sensor 31 is fixed to the sensor accommodating chamber 30*a*. An opening on the right surface side of the sensor accommodating chamber 30*a* is covered with a cover member 33, and the circuit board 34 is fixed to an outer surface 33*a* of the cover member 33. The sensor accommodating chamber 30*a*, the sensor 31, the fixed spring 32, the cover member 33, the circuit board 34, and a sensor flow channel forming chamber 30*b* (described below) are collectively called a sensor unit 30.

Though not shown in detail, the sensor 31 includes a cavity forming a part of an ink flow section described below, a vibrating plate forming a part of a wall surface of the cavity, and a piezoelectric element disposed on the vibrating plate. A terminal of the piezoelectric element is electrically connected to part of the electrode terminals of the circuit board 34. When the ink cartridge 1 is mounted in the ink jet printer, the terminal of the piezoelectric element is electrically connected to the ink jet printer through the electrode terminals of the circuit board 34. Then, if the ink jet printer supplies electrical energy to the piezoelectric element, the vibrating plate can be vibrated by means of the piezoelectric element. Thereafter, the ink jet printer detects the characteristic of residual vibration of the vibrating plate (frequency and the like) through the piezoelectric element. In this way, the ink jet printer can detect presence or absence of ink in the cavity. Specifically, if ink contained in the cartridge main body 10 is exhausted, and the inside of the cavity is changed from an ink-filled state to an air-filled state, the characteristic of residual vibration of the vibrating plate is changed. The ink jet printer can detect presence or absence of ink in the cavity by detecting the change in the vibration characteristic with the sensor 31.

On the circuit board 34, a rewritable nonvolatile memory, such as EEPROM (Electronically Erasable and Programmable Read Only Memory) or the like, is provided, in which the amount of ink consumed by the ink jet printer and the like are recorded.

On the bottom surface side of the cartridge main body 10, in addition to the liquid supply section 50 and the air releasing port 100 described above, a pressure reducing port 110, a sensor flow channel forming chamber 30*b*, and an tortuous flow channel forming chamber 95*a* are provided (FIG. 4). The pressure reducing port 110 is used to suck out air and reduce the pressure in the ink cartridge 1 when ink is injected during a manufacturing process of the ink cartridge 1. The sensor flow channel forming chamber 30*b* and the tortuous flow channel forming chamber 95*a* form a part of an ink flow section described below.

The liquid supply section 50, the air releasing port 100, the pressure reducing port 110, the tortuous flow channel forming chamber 95*a*, the sensor flow channel forming chamber 30*b* are sealed by sealing films 54, 90, 98, 95, and 35, respectively, immediately after the ink cartridge 1 is manufactured. Of these, the sealing film 90 is removed by the user before the ink cartridge 1 is mounted on the carriage 200 of the ink jet printer, as described above. Therefore, the air releasing port 100 communicates with the outside, and air is introduced into the ink cartridge 1. The sealing film 54 is broken by an ink supply needle 240 provided in the carriage 200 when the ink cartridge 1 is mounted on the carriage 200 of the ink jet printer.

In the liquid supply section 50, a sealing member 51, a spring retainer 52, and a closing spring 53 are accommodated in that order from the lower surface side. The sealing member 51 seals in a manner that, when the ink supply needle 240 is inserted into the liquid supply section 50, no clearance is generated between the inner wall of the liquid supply section 50 and the outer wall of the ink supply needle 240. The spring retainer 52 comes into contact with the inner wall of the sealing member 51 to close the liquid supply section 50 when the ink cartridge 1 is not mounted on the carriage 200. The closing spring 53 urges the spring retainer 52 in a direction to bring into contact with the inner wall of the sealing member 51. If the ink supply needle 240 is inserted into the liquid supply section 50, the top end of the ink supply needle 240 presses up the spring retainer 52. Therefore, a clearance is generated between the spring retainer 52 and the sealing member 51, and then ink is supplied to the ink supply needle 240 through the clearance.

Figure 6:
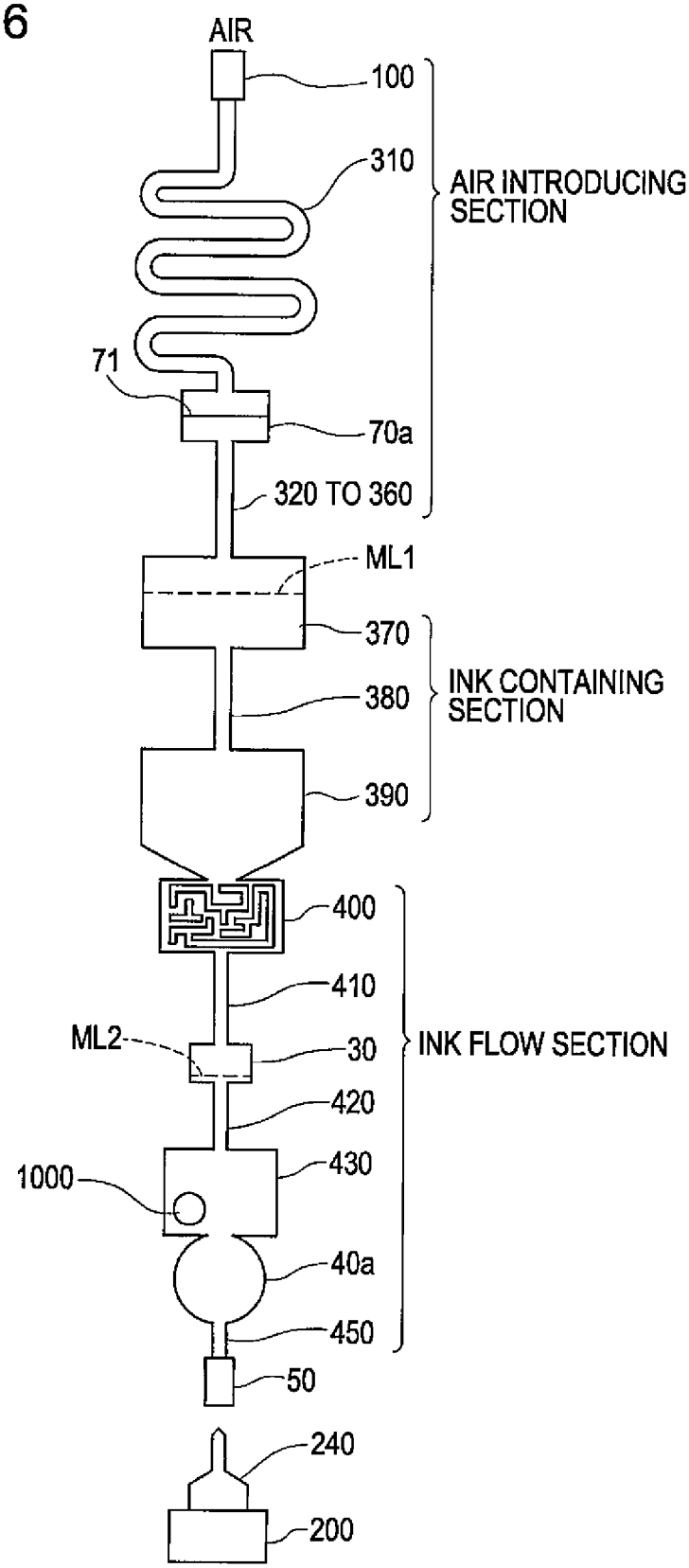
FIG. 6 is a diagram conceptually showing a path from an air releasing port to a liquid supply section.

Next, before describing the internal structure of the ink cartridge 1 in detail, for ease of understanding, a path from the air releasing port 100 to the liquid supply section 50 will be conceptually described with reference to FIG. 6. FIG. 6 is a diagram conceptually showing a path from an air releasing port to a liquid supply section.

The path from the air releasing port 100 to the liquid supply section 50 is divided into an ink containing section for containing ink, an air introducing section on an upstream side of the ink containing section, and an ink flow section on a downstream side of the ink containing section.

The ink containing section includes, in due order from the upstream side, a first ink containing chamber 370, a containing chamber connecting channel 380, and a second ink containing chamber 390. An upstream side of the containing chamber connecting channel 380 communicates with the first ink containing chamber 370, and a downstream side of the containing chamber connecting channel 380 communicates with the second ink containing chamber 390.

The air introducing section includes, in due order from the upstream side, a serpentine channel 310, an air-liquid separating chamber 70*a* in which the air-liquid separating film 71 is housed, and connecting portions 320 to 360 which connect the air-liquid separating chamber 70*a* and the ink containing section. An upstream end of the serpentine channel 310 communicates with the air releasing port 100, and a downstream end of the serpentine channel 310 communicates with the air-liquid separating chamber 70*a*. The serpentine channel 310 is formed long and slender in a serpentine shape so as to extend a distance from the air releasing port 100 to the first ink containing section. Therefore, it is possible to suppress evaporation of moisture from ink in the ink containing section. The air-liquid separating film 71 is made of a material that transmits air but blocks a liquid. If the air-liquid separating film 71 is disposed between the upstream side and the downstream side of the air-liquid separating chamber 70*a*, ink flowing back from the ink containing section can be prevented from entering the upstream side above the air-liquid separating chamber 70*a*. The detailed configuration of the connecting portions 320 to 360 will be described below.

The ink flow section includes, in due order from the upstream side, an tortuous flow channel 400, a first flow channel 410, the sensor unit 30, a second flow channel 420, a buffer chamber 430, a valve accommodating chamber 40*a* in which the differential pressure regulating valve 40 is accommodated, and a third flow channel 450. The tortuous flow channel 400 includes a space defined by the tortuous flow channel forming chamber 95*a* and has a three-dimensional maze shape. Air bubbles mixed into ink are caught by the tortuous flow channel 400. Therefore, it is possible to, prevent air bubbles from being mixed into ink on the downstream side from the tortuous flow channel 400. An upstream end of the first flow channel 410 communicates with the tortuous flow channel 400, and a downstream end of the first flow channel 410 communicates with the sensor flow channel forming chamber 30*b* of the sensor unit 30. An upstream end of the second flow channel 420 communicates with the sensor flow channel forming chamber 30*b* of the sensor unit 30, and a downstream end of the second flow channel 420 communicates with the buffer chamber 430. The stirring ball 1000 is disposed inside the buffer chamber 430. The buffer chamber 430 directly communicates with the valve accommodating chamber 40*a*, while the flow channel does not become narrow. Therefore, a space from the buffer chamber 430 to the liquid supply section 50 can be made small, and a possibility that ink remains and is settled after being stirred can be reduced. In the valve accommodating chamber 40*a*, the differential pressure regulating valve 40 regulates the pressure of ink on the downstream side below the valve accommodating chamber 40*a* to be lower than the pressure of ink on the upstream side. Ink on the downstream side has a negative pressure. An upstream end of the third flow channel 450 communicates with the valve accommodating chamber 40*a*, and a downstream end of the third flow channel 450 communicates with the liquid supply section 50.

When the ink cartridge 1 is manufactured, as shown in FIG. 6, in which a liquid level is conceptually indicated by a broken line ML1, ink is filled up to the first ink containing chamber 370. If ink in the ink cartridge 1 is consumed by the ink jet printer, the liquid level is moved to the downstream side, and air flows into the ink cartridge 1 from the upstream side through the air releasing port 100. Thereafter, if ink is further consumed, as shown in FIG. 6 in which the liquid level is indicated by a broken line ML2, the liquid level reaches the sensor unit 30. Then, air is introduced into the sensor unit 30, and out-of-ink is detected using the sensor 31. After out-of-ink is detected, the ink cartridge 1 interrupts printing before ink on the downstream side (the buffer chamber 430 or the like) of the sensor unit 30 is exhausted, and notifies the user of out-of-ink. If printing is further performed with ink exhausted, air may be introduced into the printing head, and any trouble may occur.

Figure 7:
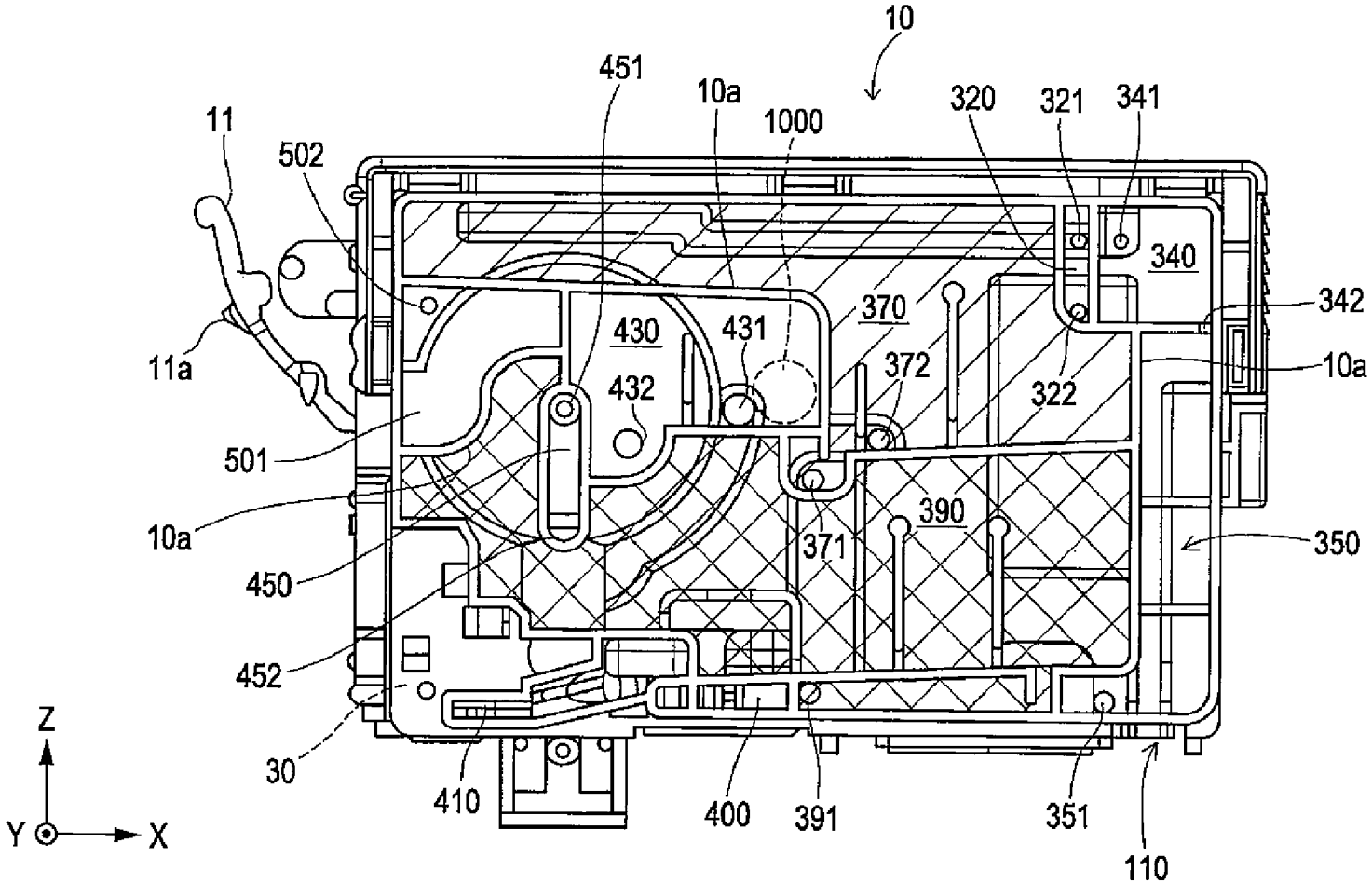
FIG. 7 is a diagram showing a cartridge main body when viewed from the front surface.
Figure 8:
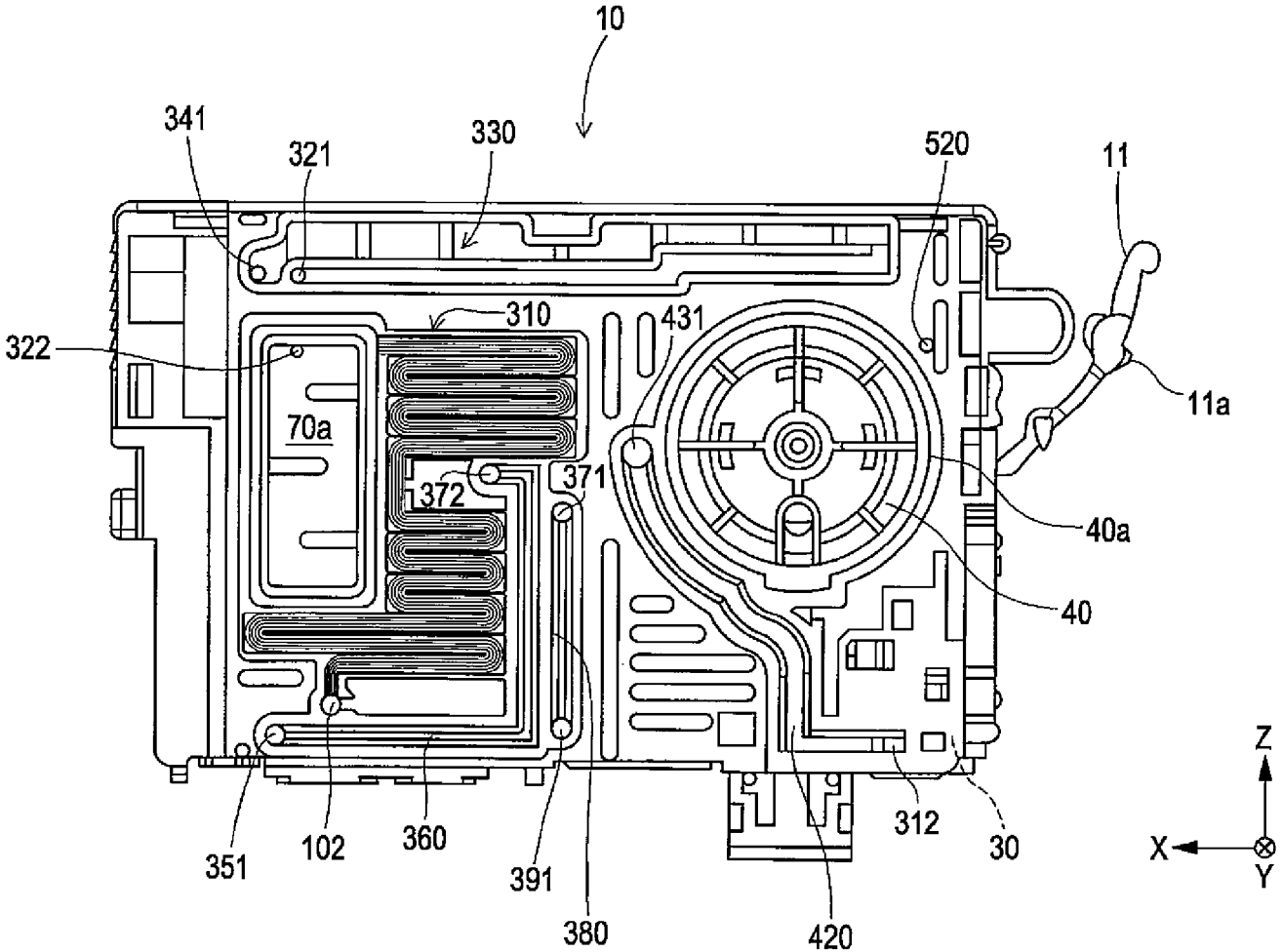
FIG. 8 is a diagram showing a cartridge main body when viewed from the back surface.
Figure 9A:
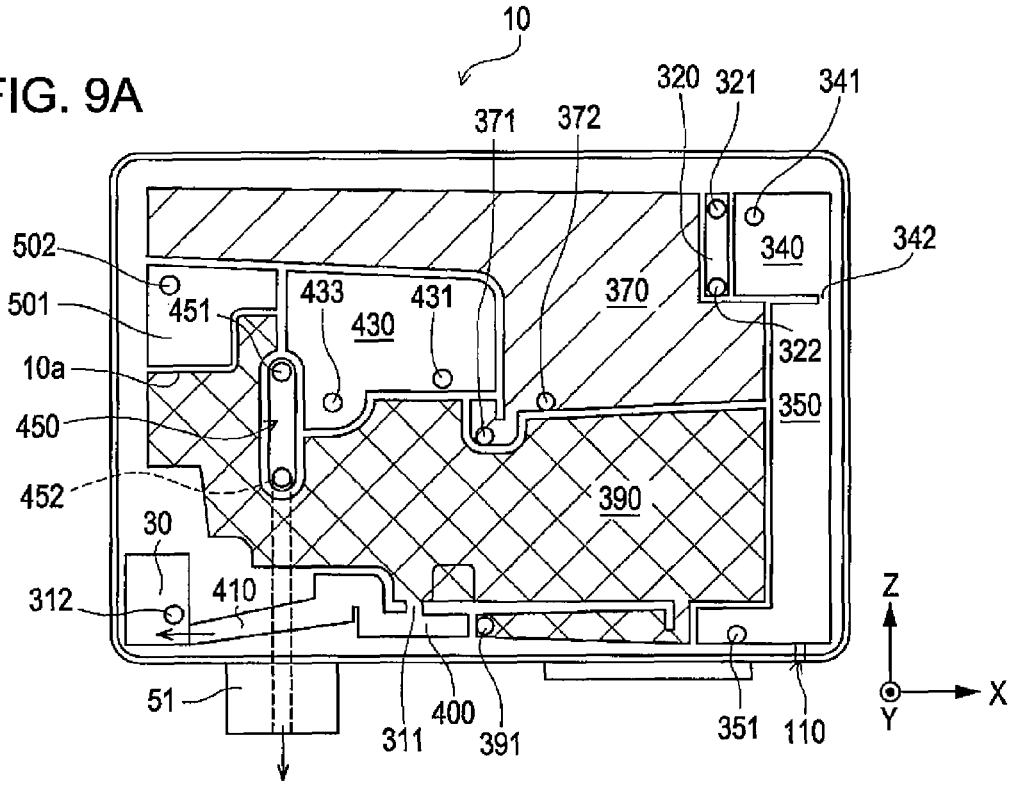
FIGS. 9A and 9B are schematic views of FIGS. 7 and 8, respectively.
Figure 9B:
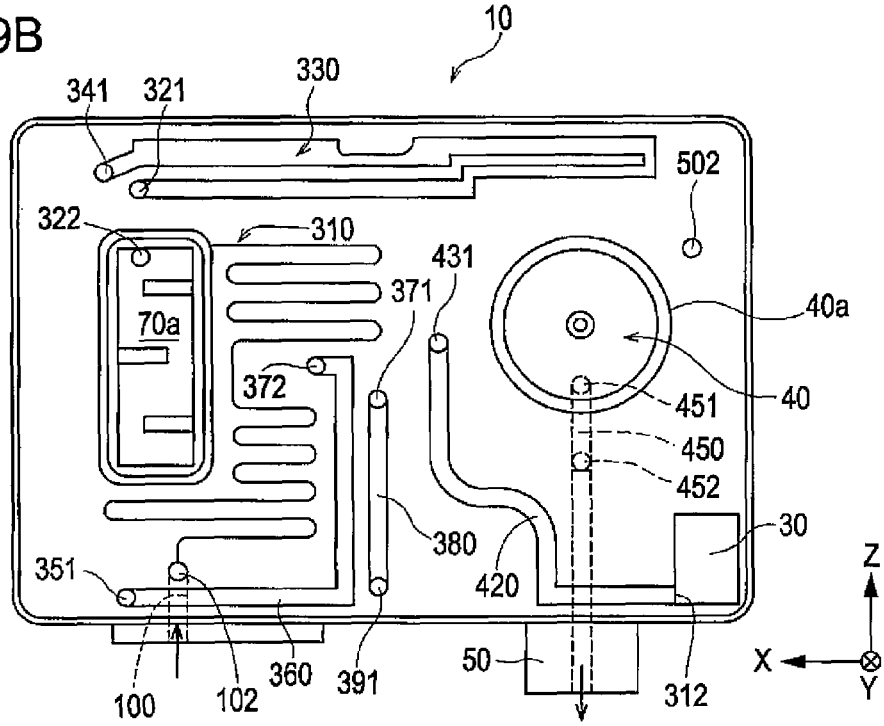

Based on the above description, parts in the ink cartridge 1 on the path from the air releasing port 100 to the liquid supply section 50 will be described in detail with reference to FIGS. 7, 8, and 9A and 9E. FIG. 7 is a diagram showing the cartridge main body 10 when viewed from the front surface side. FIG. 8 is a diagram showing the cartridge main body 10 when viewed from the back surface side. FIG. 9A is a schematic view of FIG. 7. FIG. 9B is a schematic view of FIG. 8.

In the ink containing section, the first ink containing chamber 370 and the second ink containing chamber 390 are formed on the front surface side of the cartridge main body 10. In FIGS. 7 and 9A, the first ink containing chamber 370 and the second ink containing chamber 390 are represented by a single-hatching region and a cross-hatching region, respectively. The containing chamber connecting channel 380 is formed on the back surface side of the cartridge main body 10 at a position shown in FIGS. 8 and 9B. A communicating port 371 communicates the upstream end of the containing chamber connecting channel 380 and the first ink containing chamber 370. A communicating port 391 communicates the downstream end of the containing chamber connecting channel 380 and the second ink containing chamber 390.

In the air introducing section, the serpentine channel 310 and the air-liquid separating chamber 70*a* are formed on the back surface side of the cartridge main body 10 at positions shown in FIGS. 8 and 9B, respectively. A communicating port 102 communicates the upstream end of the serpentine channel 310 and the air releasing port 100. The downstream end of the serpentine channel 310 passes through a side wall of the air-liquid separating chamber 70*a* and communicates with air-liquid separating chamber 70*a*.

In detail, the connecting portions 320 to 360 of the air introducing section shown in FIG. 6 include a first space 320, a third space 340, and a fourth space 350 (see FIGS. 7 and 9A) disposed on the front surface side of the cartridge main body 10, and a second space 330 and a fifth space 360 (see FIGS. 8 and 9B) disposed on the back surface side of the cartridge main body 10. These spaces 320 to 360 are disposed in series in that order from the upstream side, to thereby form a single flow channel. A communicating port 322 communicates the air-liquid separating chamber 70*a* and the first space 320. Communicating ports 321 and 341 communicate the first space 320 and the second space 330, and the second space 330 and the third space 340, respectively. A cutout 342 formed in a rib separating the third space 340 and the fourth space 350 communicates the third space 340 and the fourth space 350. Communicating ports 351 and 372 communicate the fourth space 350 and the fifth space 360, and the fifth space 360 and the first ink containing chamber 370, respectively.

In the ink flow section, the tortuous flow channel 400 and the first flow channel 410 are formed on the front surface side of the cartridge main body 10 at positions shown in FIGS. 7 and 9A, respectively. A communicating port 311 is provided in a rib separating the second ink containing chamber 390 and the tortuous flow channel 400 and communicates the second ink containing chamber 390 and the tortuous flow channel 400. As described with reference to FIG. 4, the sensor unit 30 is disposed on the lower side of the right surface of the cartridge main body 10 (FIGS. 7, 8, and 9A and 9B). The second flow channel 420 and the air-liquid separating chamber 70*a* are formed on the back surface side of the cartridge main body 10 at positions shown in FIGS. 8 and 9B, respectively. The buffer chamber 430 and the third flow channel 450 are formed on the front surface side of the cartridge main body 10 at positions shown in FIGS. 7 and 9A, respectively. A communicating port 312 communicates the tortuous flow channel forming chamber 95*a* of the sensor unit 30 (FIG. 4) and the upstream end of the second flow channel 420. A communicating port 431 communicates the downstream end of the second flow channel 420 and the buffer chamber 430. A communicating port 432 directly communicates the buffer chamber 430 and the valve accommodating chamber 40*a*. Communicating ports 451 and 452 communicate the valve accommodating chamber 40*a* and the third flow channel 450, and the third flow channel 450 and the ink supply port in the liquid supply section 50, respectively.

A space 501 shown in FIGS. 7 and 9A refers to an unfilled chamber in which ink is not filled. The unfilled chamber 501 is independently provided, not on the path from the air releasing port 100 to the liquid supply section 50. On the back surface side of the unfilled chamber 501, an air communicating port 502 communicating with the air is provided. The unfilled chamber 501 serves as a deaerating chamber accumulating a negative pressure when the ink cartridge 1 is packaged by means of reduced-pressure packaging. Therefore, in a state in which the ink cartridge 1 is packaged, the pressure in the cartridge main body 10 is maintained to be less than a prescribed value, and thus ink with a small amount of dissolved air can be supplied.

Configuration of Buffer Chamber 430

Figure 10:
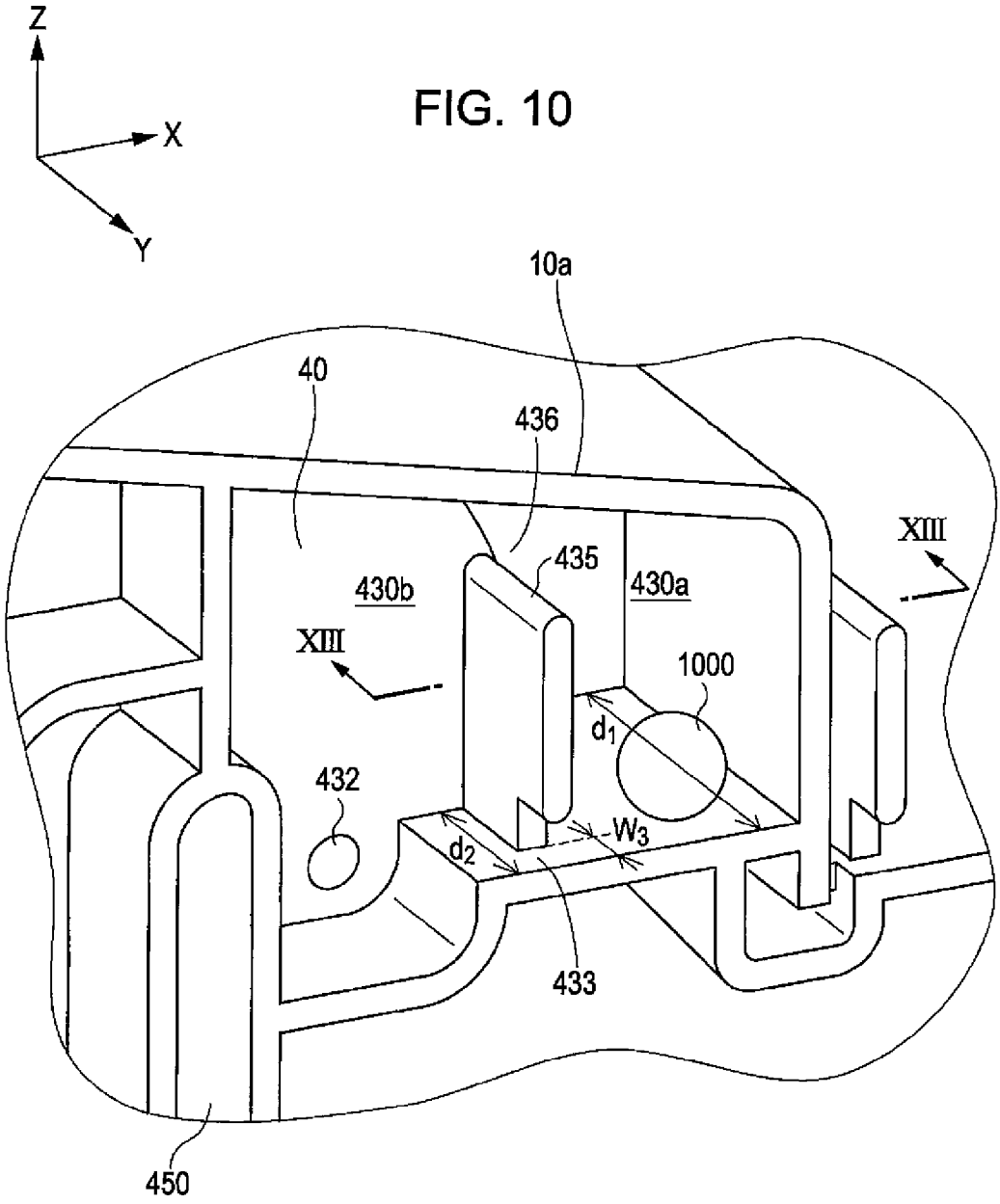
FIG. 10 is a first enlarged perspective view of a portion around a buffer chamber.
Figure 11:
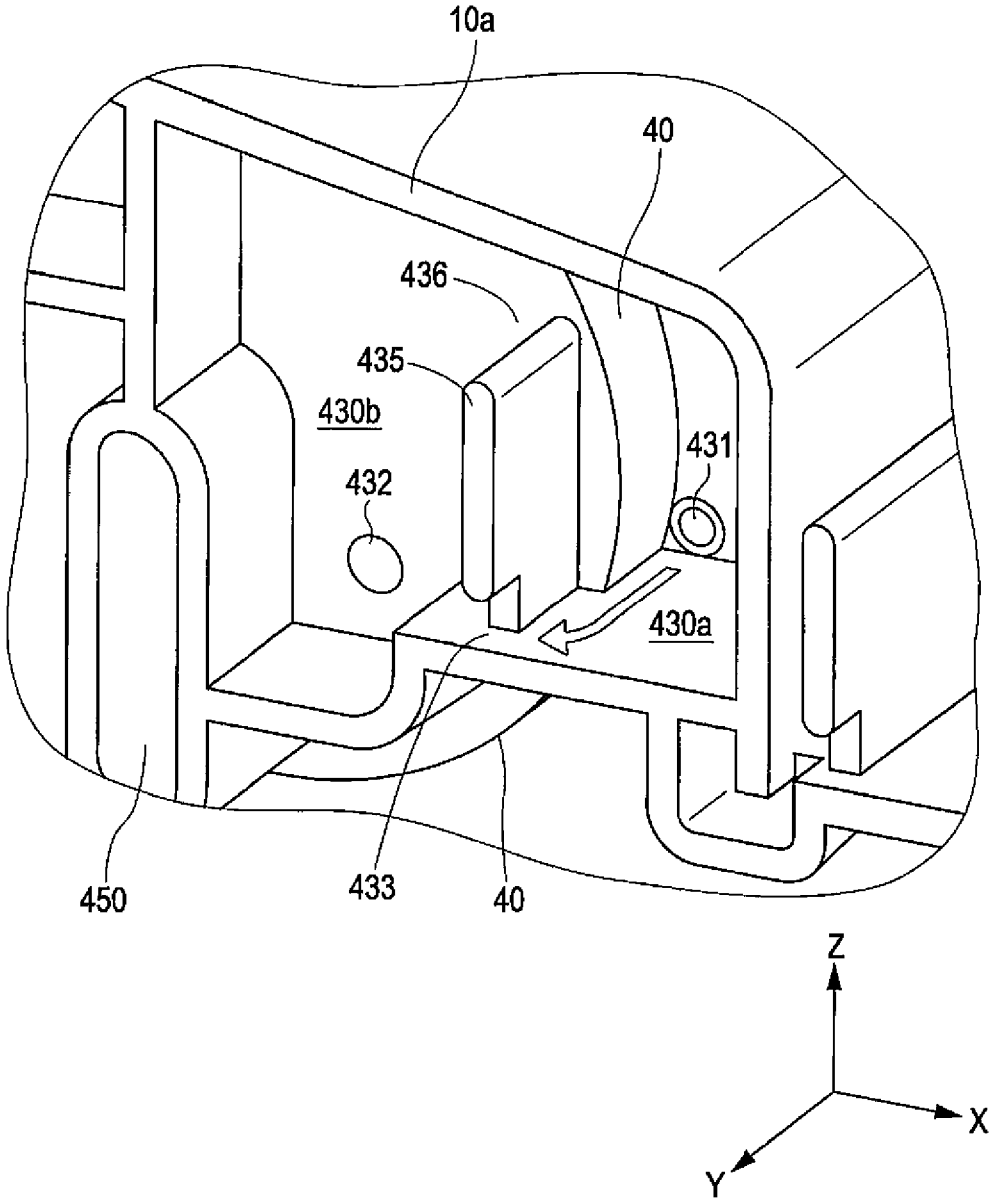
FIG. 11 is a second enlarged perspective view of a portion around a buffer chamber.
Figure 12:
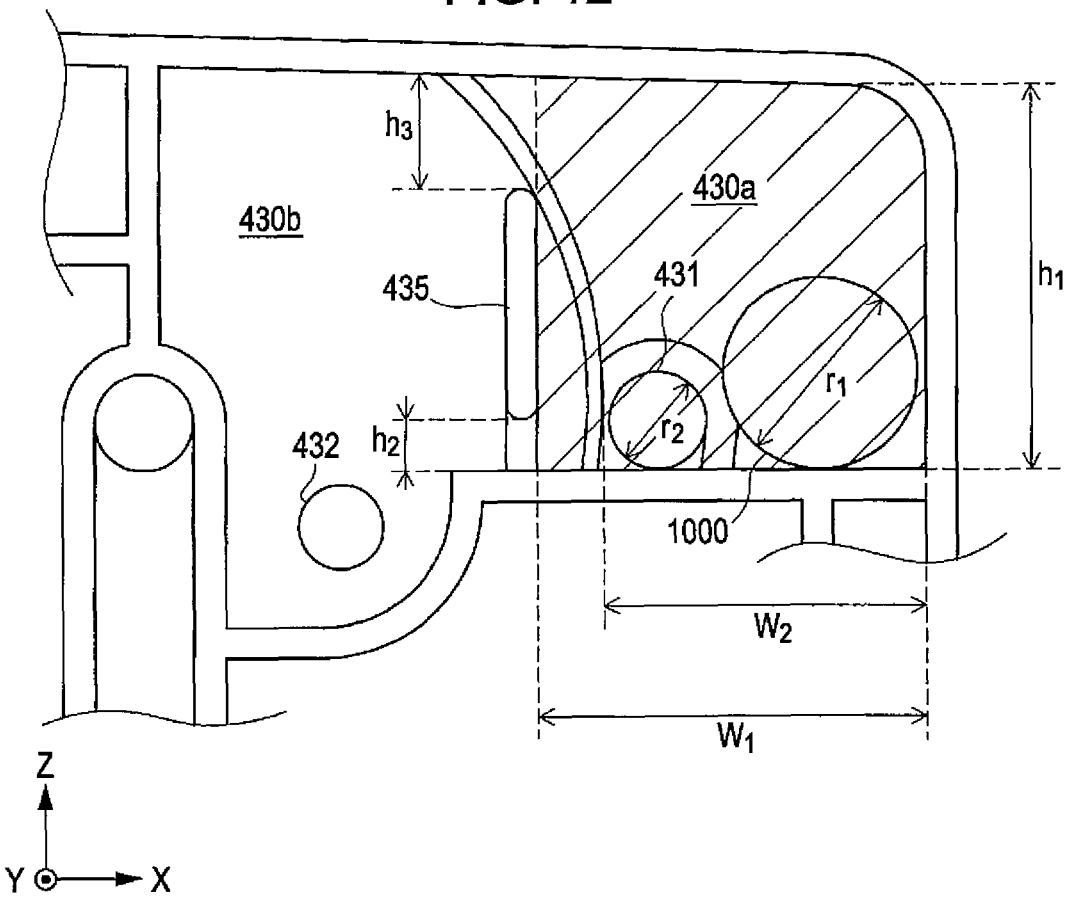
FIG. 12 is a diagram showing a buffer chamber when viewed from the front surface.
Figure 13:
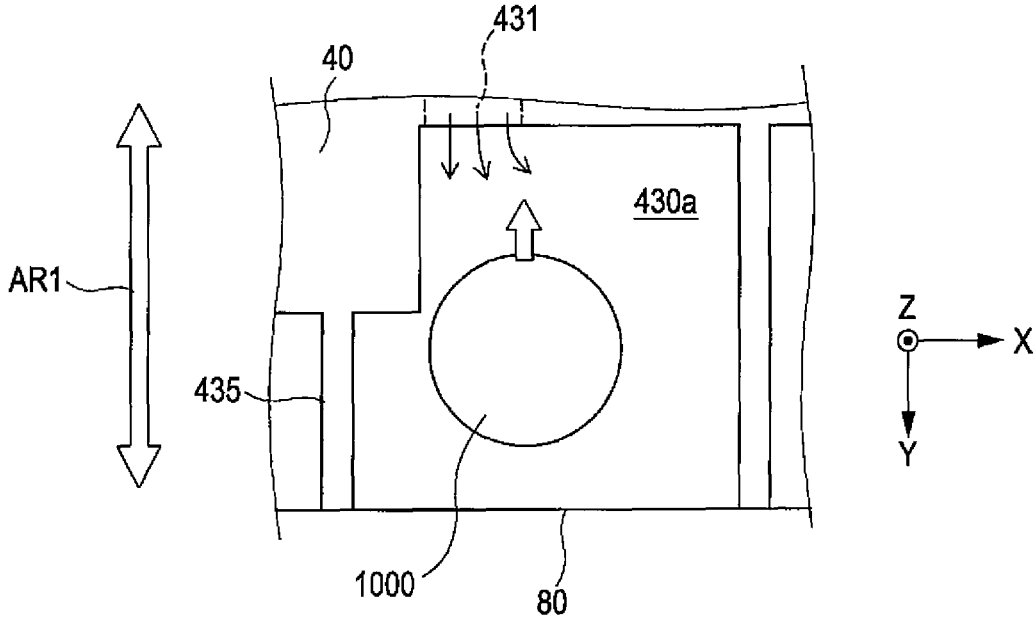
FIG. 13 is a diagram showing a buffer chamber when viewed from the top surface.

Next, the buffer chamber 430 and the stirring ball 1000 disposed in the buffer chamber 430 will be further described with reference to FIGS. 10 to 13. FIG. 10 is a first enlarged perspective view of a portion around the buffer chamber 430. FIG. 11 is a second enlarged perspective view of a portion around the buffer chamber 430. FIGS. 10 and 11 are diagrams when the same portion around the buffer chamber 430 is viewed at different angles. FIG. 12 is a diagram showing the buffer chamber 430 when viewed from the front surface side. FIG. 13 is a diagram showing the buffer chamber 430 when viewed from the top surface side. FIG. 13 is a cross-sectional view of the buffer chamber 430 taken along a plane perpendicular to the Z axis including the line XIII-XIII of FIG. 10 when viewed from the top surface side.

The buffer chamber 430 is divided into an upstream portion 430*a* and a downstream portion 430*b* by a partitioning rib 435. In the upstream portion 430*a*, the stirring ball 1000 is disposed. At a wall on the back surface side of the upstream portion 430*a*, that is, at an inner wall perpendicular to the Y axis, the communicating port 431 is provided (FIGS. 11 and 12). A cutout 433 is provided on the lower surface side of the partitioning rib 435 of the upstream portion 430*a*. A clearance 436 is provided on the upper surface side of the partitioning rib 435.

Ink from the sensor unit 30 through the second flow channel 420 flows into the buffer chamber 430 from the communicating port 431, and flows in the downstream portion 430*b* from the cutout 433 or the clearance 436. That is, the communicating port 431 serving as an inflow port is located on the back surface side and the left surface side of the upstream portion 430*a*. The cutout 433 and the clearance 436 serving as an outflow port are located on the front surface side and the left surface side of the upstream portion 430*a*. Therefore, in FIG. 11, as indicated by an outline arrow, ink flows in the upstream portion 430*a* in the Y-axis direction. As described above, the Y-axis direction refers to a direction in which the ink cartridge 1 reciprocates together with the carriage 200. Therefore, the stirring ball 1000 in the upstream portion 430*a* is moved in the Y-axis direction by means of the flow of ink in the upstream portion 430*a*, as well as the reciprocation of the carriage 200. As a result, ink in the upstream portion 430*a* is effectively stirred, and thus the uniformity of ink is improved. As understood from the above description, in this embodiment, the upstream portion 430*a* corresponds to a movement direction flow section read on the appended claims.

The width d1 of the upstream portion 430*a* in the Y-axis direction (FIG. 10) is, for example, approximately 10 mm (millimeter). The width d2 of the downstream portion 430*b* in the Y-axis direction (FIG. 10) is smaller than the width d1 of the upstream portion 430*a* in the Y-axis direction, for example, approximately 5 mm, because the valve accommodating chamber 40*a* is formed on the back surface side of the downstream portion 430*b*. The diameter of the stirring ball 1000 is approximately 5 mm, and considering a manufacturing error, it is in a range of 4.5 mm to 5.7 mm. The width d1 of the upstream portion 430*a* in the Y-axis direction is approximately two times of the diameter of the stirring ball 1000. Therefore, the movement distance of the stirring ball 1000 in the Y-axis direction is sufficiently ensured. As for the width of the upstream portion 430*a* in the X-axis direction, the width W1 on the front surface side is approximately 9 mm, and the width W2 on the back surface side is approximately 7 mm. As such, the width d1 of the upstream portion 430*a* in the Y-axis direction is preferably larger than the width of the upstream portion 430*a* in the X-axis direction. The reason is as follows. A force for moving the stirring ball 1000 in the Y-axis direction (a force according to the reciprocation of the carriage 200 or the flow of ink) acts on the stirring ball 1000, but it does not act in the X-axis direction so much. For this reason, if the width in the X-axis direction is set to be narrower than the width in the Y-axis direction, ink in the upstream portion 430*a* can be sufficiently stirred only with the movement of the stirring ball 1000 in the Y-axis direction. In the embodiment, the X-axis direction corresponds to a direction perpendicular to a movement direction and a gravity direction.

The width h1 of the upstream portion 430*a* in the Z-axis direction (the width in the gravity direction) is approximately 10 mm. As such, the width of the stirring ball 1000 in the Z-axis direction (in this embodiment, since the stirring ball 1000 is in a sphere shape, the width refers to the diameter r1 of the stirring ball 1000) is preferably approximately half or more of the width of the upstream portion 430*a* in the Z-axis direction. As described above, the reason is because the stirring ball 1000 can be expected to be moved in the Y-axis direction, but not in the Z-axis direction. For this reason, if the width of the stirring ball 1000 in the Z-axis direction is set to be approximately half or more of the width of the upstream portion 430*a* in the Z-axis direction, ink in the upstream portion 430*a* can be sufficiently stirred only with the movement of the stirring ball 1000 in the Y-axis direction.

The projected area S1 (the hatching region in FIG. 12) of the upstream portion 430*a* in the Y-axis direction, i.e., on the XZ-plane perpendicular to the Y-axis direction, is approximately 91 mm2 (square millimeter). The projected area S2 of the stirring ball 1000 in the Y-axis direction is in a range of approximately 17 mm2 to 25 mm2. Therefore, the ratio of the projected area S2 of the stirring ball 1000 in the Y-axis direction to the projected area S of the upstream portion 430*a* in the Y-axis direction is in a range of approximately 18% to 27%. This ratio is preferably in a range of 15% to 30%. If the ratio is less than 15%, the stirring ball 1000 is small, and accordingly ink in the upstream portion 430*a* may not be sufficiently stirred only with the movement in the Y-axis direction. In addition, if the ratio is more than 30%, the stirring ball 1000 is large, and accordingly a smooth flow of ink in the upstream portion 430*a* may be obstructed.

The projected area of the downstream portion 430*b* in the Y-axis direction, i.e., on the XZ-plane perpendicular to the Y-axis direction, is approximately 102 mm2. Therefore, the projected area of the entire buffer chamber 430 in the Y-axis direction is approximately 193 mm2. The ratio of the projected area S2 of the stirring ball 1000 in the Y-axis direction to the projected area of the buffer chamber 430 in the Y-axis direction is in a range of approximately 9% to 13%.

The ratio of the volume of the stirring ball 1000 to the volume of the upstream portion 430*a* is in a range of approximately 5% to 15%. If the ratio is too small, the entire ink in the upstream portion 430*a* may not be sufficiently stirred. If the ratio is too large, a smooth flow of ink in the upstream portion 430*a* may be obstructed.

As shown in FIG. 13, the communicating port 431 serving as an ink inflow port is provided at an inner wall perpendicular to the Y axis. Then, the movement direction of the stirring ball 1000 to be expected is the Y-axis direction. For this reason, as shown in FIG. 13, when the stirring ball 1000 moves in the negative Y-axis direction, the stirring ball 1000 collides against the flow of ink from the communicating port 431 to the upstream portion 430*a* (FIG. 13: dashed arrow) from the front surface. As a result, ink flowing from the communicating port 431 to the upstream portion 430*a* is diffused over the entire upstream portion 430*a* and effectively stirred.

The width h2 of the cutout 433 in the Z-axis direction and the width w3 of the cutout 433 in the Y-axis direction, the width h3 of the clearance 436 in the Z-axis direction, and the diameter r2 of the communicating port 431 are sufficiently smaller than the diameter r1 of the stirring ball 1000. Therefore, there is no case in which the stirring ball 1000 is caught by the cutout 433, the clearance 436, or the communicating port 431 and clogged, and the movement of the stirring ball 1000 is obstructed.

Figure 14A:
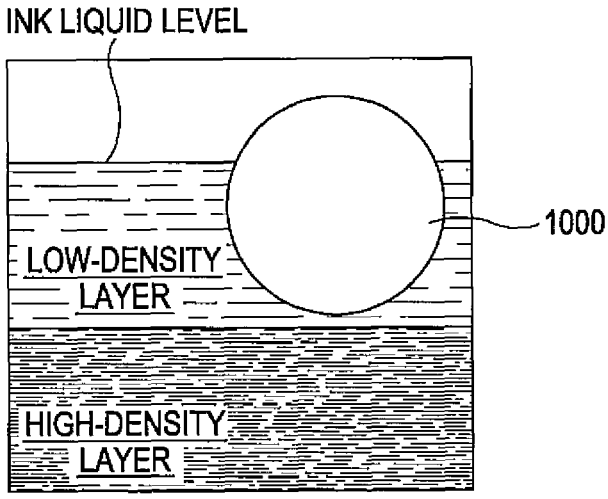
FIGS. 14A to 14C are explanatory views illustrating the specific gravity of a stirring ball.
Figure 14B:
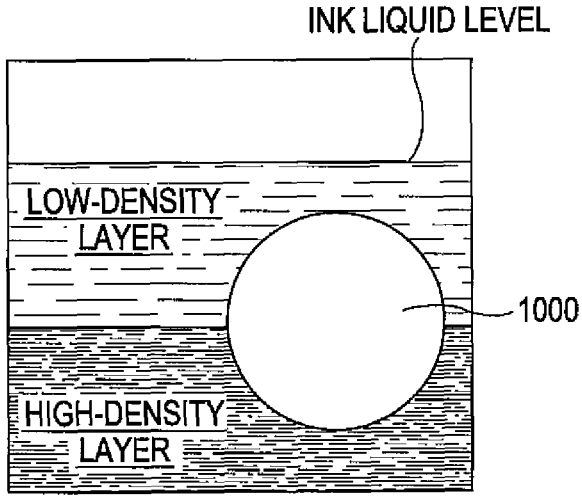
Figure 14C:
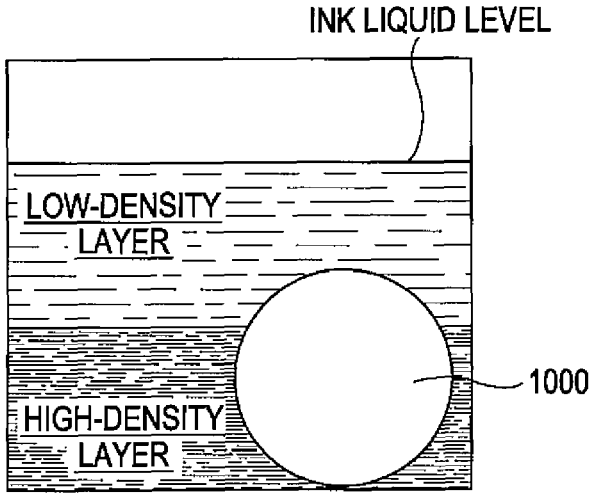

The stirring ball 1000 has identical specific gravity to or higher specific gravity than the specific gravity that ink has. The stirring ball 1000 is made of, for example, an organic material, such as resin or the like, an inorganic material, such as a metal or the like, or a composite material of them. FIGS. 14A to 14C are explanatory views illustrating the specific gravity of the stirring ball 1000. As shown in FIGS. 14A to 14C, if ink containing a plurality of components having different specific gravities (for example, pigment ink) is left for a long time, ink is divided into a high-density layer (for example, a dispersed particle layer) and a low-density layer (for example, a solvent layer). At this time, if the stirring ball 1000 is smaller than ink in specific gravity, the stirring ball 1000 is floated on ink (FIG. 14A). Then, when ink is not filled in the entire buffer chamber 430, an upper portion of the stirring ball 1000 remains above the liquid level of ink, and accordingly it is impossible to stir ink by effectively using the entire stirring ball 1000. In addition, since the stirring ball 1000 exists in the low-density layer and stirs the low-density layer, it is impossible to efficiently stir ink.

When the stirring ball 1000 has identical specific gravity to the specific gravity that ink has, the stirring ball 1000 is located at the boundary of the high-density layer and the low-density layer. Therefore, it is possible to efficiently stir ink by using the entire stirring ball 1000. In addition, since both the low-density layer and the high-density layer are stirred, the ink uniformity can be improved.

If the stirring ball 1000 has higher specific gravity than the specific gravity that ink has, the stirring ball 1000 sinks in the high-density layer. Then, it is possible to efficiently stir ink by using the entire stirring ball 1000. In addition, when the high-density layer is preponderantly stirred, the entire ink is likely to be uniformly stirred, as compared with a case in which the low-density is preponderantly stirred.

According to the foregoing embodiment, since the stirring ball 1000 is disposed on the downstream side below the sensor unit 30, that is, on the liquid supply section 50 side. Therefore, after out-of-ink is detected using the sensor unit 30, ink remaining in the ink cartridge 1 can be improved in uniformity. As a result, until ink in the ink cartridge 1 is exhausted, the ink uniformity can be maintained.

The buffer chamber 430 in which the stirring ball 1000 is accommodated directly communicates with the valve accommodating chamber 40*a*, in which the differential pressure regulating valve 40 is accommodated, through the communicating port 432. As a result, the space from the buffer chamber 430 to the liquid supply section 50 can be made small, and thus a possibility that ink remains and is settled after being stirred can be reduced.

When the carriage 200 reciprocates, the stirring ball 1000 moves along the movement direction of the reciprocation (in this embodiment, the Y-axis direction). Then, ink is stirred in the upstream portion 430*a* of the buffer chamber 430. In this case, in the upstream portion 430*a*, a flow channel is formed, through which ink flows according to the reciprocation of the carriage 200. As a result, when the carriage 200 is not in reciprocation, the stirring ball 1000 is moved according to the flow of ink, and thus ink can be stirred. An ink jet printer may perform a cleaning process, in which ink is consumed, before printing with the carriage 200 stopped. In this embodiment, during such a cleaning process, the stirring ball 1000 is urged to move with the flow of ink and stirs ink, such that the ink uniformity can be improved. The cleaning process includes flushing in which ink is ejected from the nozzles of the printing head to thereby resolve nozzle clogging, and suction cleaning which is executed when nozzle clogging is not resolved with flushing.

In this embodiment, the size and specific gravity of the stirring ball 1000, and the shape and size of the upstream portion 430*a* in the buffer chamber 430 are suitably set, as described above. As a result, the ink stirring capability of the stirring ball 1000 in the upstream portion 430*a* can be improved, and thus the ink uniformity can be improved.

Modifications

Although in the foregoing embodiment, the spherical stirring ball 1000 is used as a stirring member, the stirring ball 1000 may have various shapes. For example, an elliptical stirring member may be used. In this case, the stirring member may be moved irregularly. Furthermore, an uneven shape or a small fin may be provided in the surface of the stirring ball 1000. In this case, a stirring operation may be performed further strongly.

Although in the foregoing embodiment, the invention is applied for stirring ink, such as pigment or the like, the invention may be applied to containers which contain various liquids. For example, the invention may be applied to a liquid container that, to an apparatus which ejects a liquid material with fine particles of an electrode material mixed in a solvent onto a semiconductor to form an electrode on the semiconductor, supplies the liquid material.

In the foregoing embodiment, the shape and size of the ink cartridge 1 including the shapes and sizes of the buffer chamber 430 and the upstream portion 430*a*, and the shape and size of the stirring ball 1000 are specified, but they are just examples. The shapes and sizes may be altered and improved within the scope to be apparent to those skilled in the art.

Although the invention has been described in connection with the embodiment and modifications, the foregoing embodiment is merely for facilitating understanding of the invention, but is not meant to be interpreted in a manner limiting the scope of the invention. The invention can of course be altered and improved without departing from the gist thereof and the appended claims, and includes the equivalents thereof.

The entire disclosure of Japanese Patent Application No. 2007-200709, filed Aug. 1, 2007 is expressly incorporated by reference herein.

What is claimed is:

1. A liquid container for supplying a liquid to a liquid consuming apparatus, the liquid container comprising:

a liquid containing section that contains the liquid;

a liquid supply section that supplies the liquid to the liquid consuming apparatus;

a liquid flow section that connects from the liquid containing section to the liquid supply section;

a sensor that is provided in the liquid flow section and used for detecting presence or absence of the liquid at a corresponding position thereof;

a stirring member that stirs the liquid, the stirring member provided at a position between the sensor and the liquid supply section in the liquid flow section; and a buffer chamber provided in the liquid flow section at a position between the sensor and the liquid supply section;

wherein the liquid container is mounted in use on a mounting portion which is provided in the liquid consuming apparatus to reciprocate in a predetermined movement direction, the buffer chamber includes a movement direction flow section in which the liquid flows along the movement direction, and the stirring member is disposed in the movement direction flow section of the buffer chamber and stirs the liquid in the buffer chamber.

2. The liquid container according to claim 1, wherein a ratio of a projected area of the stirring member on a plane perpendicular to the movement direction to a projected area of the movement direction flow section on the plane is greater than or equal to 0.15.

3. The liquid container according to claim 1, wherein a ratio of a projected area of the stirring member on a plane perpendicular to the movement direction to a projected area of the movement direction flow section on the plane is less than or equal to 0.30.

4. The liquid container according to claim 1, wherein the movement direction flow section includes an inflow port through which the liquid flows into the movement direction flow section, the inflow port having a diameter smaller than a diameter of the stirring member and being provided at an inner wall perpendicular to the movement direction.

5. The liquid container according to claim 1, wherein a width of the stirring member in a gravity direction is approximately half or more of a width of the movement direction flow section in the gravity direction.

6. The liquid container according to claim 1, wherein a width of the movement direction flow section in the movement direction is larger than a width of the movement direction flow section in a direction perpendicular to the movement direction and a gravity direction.

7. The liquid container according to claim 1, wherein a ratio of a volume of the stirring member to a volume of the movement direction flow section is greater than or equal to 0.05.

8. The liquid container according to claim 1, wherein a ratio of a volume of the stirring member to a volume of the movement direction flow section is less than or equal to 0.15.

9. A liquid container for supplying a liquid to a liquid consuming apparatus, the liquid container comprising:

a liquid containing chamber that contains the liquid;

a liquid supply section that supplies the liquid to the liquid consuming apparatus;

a sensor that is provided in a sensor accommodating chamber and used for detecting presence or absence of the liquid at a corresponding position thereof;

a first liquid flow path that connects the liquid containing chamber to the sensor accommodating chamber; and a stirring member that stirs the liquid, the stirring member provided in a stirring chamber provided in a second flow path between the sensor accommodating chamber and the liquid supply section.

10. The liquid container according to claim 9, wherein the stirring member has a specific gravity that is the same as or higher than the specific gravity of the liquid.

11. The liquid container according to claim 9, further comprising a valve accommodating chamber in which a differential pressure regulating valve for the liquid is accommodated, the valve accommodating chamber provided between the stirring chamber and the liquid supply section in the second flow path and directly communicating with the stirring chamber.

12. The liquid container according to claim 9, wherein:

the liquid container is adapted to be mounted in use on a mounting portion that is provided in the liquid consuming apparatus to reciprocate in a predetermined movement direction, the stirring chamber includes a movement direction flow section in which the liquid flows along the movement direction, and the stirring member is disposed in the movement direction flow section of the stirring chamber.

13. The liquid container according to claim 12, wherein a ratio of a projected area of the stirring member on a plane perpendicular to the movement direction to a projected area of the movement direction flow section on the plane is greater than or equal to 0.15.

14. The liquid container according to claim 12, wherein a ratio of a projected area of the stirring member on a plane perpendicular to the movement direction to a projected area of the movement direction flow section on the plane is less than or equal to 0.30.

15. The liquid container according to claim 12, wherein the movement direction flow section includes an inflow port through which the liquid flows into the movement direction flow section, the inflow port having a diameter smaller than a diameter of the stirring member and being provided at an inner wall perpendicular to the movement direction.

16. The liquid container according to claim 12, wherein a width of the stirring member in a gravity direction is approximately half or more of a width of the movement direction flow section in the gravity direction.

17. The liquid container according to claim 12, wherein a width of the movement direction flow section in the movement direction is greater than a width of the movement direction flow section in a direction perpendicular to the movement direction and a gravity direction.

18. The liquid container according to claim 12, wherein a ratio of a volume of the stirring member to a volume of the movement direction flow section is greater than or equal to 0.05.

19. The liquid container according to claim 12, wherein a ratio of a volume of the stirring member to a volume of the movement direction flow section is less than or equal to 0.15.

* * * * *